United States Patent [19]

Henry et al.

[11] Patent Number: 4,714,255

[45] Date of Patent: Dec. 22, 1987

[54] EDUCATIONAL BOARD GAME

[76] Inventors: Daniel P. Henry, 825 SE. 39th Ave.; Fredrick E. LaTorre, 5541 NE. 3rd Pl., both of Ocala, Fla. 32671; Willard I. Pope, P.O. Box 5692, Ocala, Fla. 32678

[21] Appl. No.: 872,602

[22] Filed: Jun. 10, 1986

[51] Int. Cl.[4] ..... A63F 3/00

[52] U.S. Cl. ..... 273/249

[58] Field of Search ..... 273/243, 246, 248, 249, 273/258, 263

[56] References Cited

U.S. PATENT DOCUMENTS

| | | | |
|---|---|---|---|
| 3,656,757 | 4/1972 | Carroll | 273/243 |
| 4,029,320 | 6/1977 | Hausman | 273/249 |
| 4,090,717 | 5/1978 | Rossetti | 273/249 |
| 4,557,485 | 12/1985 | London | 273/249 |

*Primary Examiner*—Richard C. Pinkham
*Assistant Examiner*—Matthew L. Schneider
*Attorney, Agent, or Firm*—Nixon & Vanderhye

[57] ABSTRACT

A question and answer game involving the field of criminal justice includes a game board, playing tokens, a die and cards. The board includes two playing tracks upon which the playing tokens move. The tracks consist of playing spaces having indicia thereon that relates to different question and answer categories. The two tracks intersect at various points and the intersection points are connected to a retaining area via a path. The retaining areas are in turn connected to one of the two tracks via a one-way path. The cards contain questions and answers relating to three levels of difficulty. Prior to the start of the game, players choose a particular level of difficulty. Thereafter, a player landing on one of the intersection points has the option of answering a question from a higher level of difficulty than that chosen by the player before the start of the game. Correctly answering the question will allow the player to move along the one-way path to a position further ahead on one of the tracks than the player would have been had the player not landed on the intersection point.

9 Claims, 4 Drawing Figures

FIG. 2
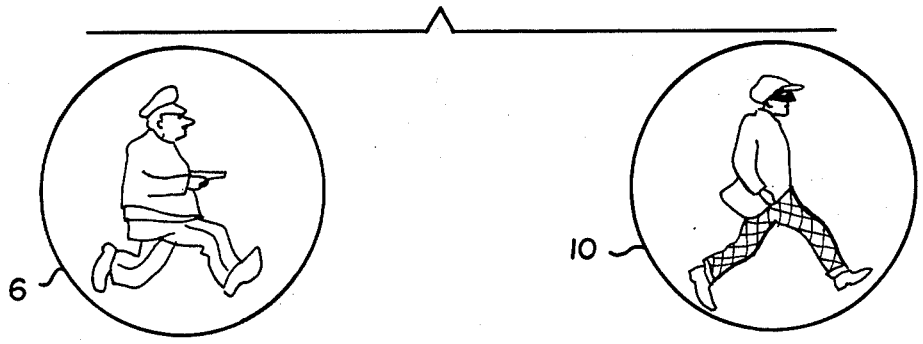
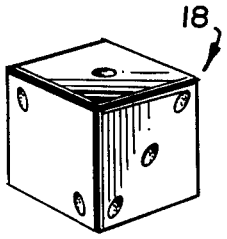
FIG. 3
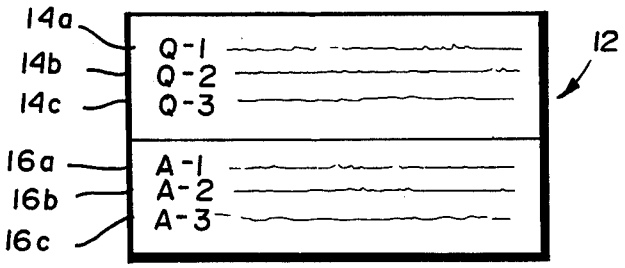
FIG. 4

EDUCATIONAL BOARD GAME

BACKGROUND AND SUMMARY OF THE INVENTION

The present invention relates to parlor games in general, and in particular to an educational board game that enables the players to learn more about the criminal justice system while being entertained and providing competition between two sides or teams. The game may be played by at least two participants, although normally play is best when there is an even number of participants divided into two separate teams.

Board and parlor games which are used to simulate various aspects of both real and imaginary experiences are, of course, well known and widely used both for entertainment as well as educational purposes. For example, there is the well known Monopoly board game (see U.S. Pat. No. 2,026,082), in which the players attempt to build real estate monopolies and divest their opponents of their real estate holdings and cash assets. Other board games have been proposed which attempt to simulate other real life experiences in the area of personal development (see e.g., U.S. Pat. No. 3,759,521), as well as the fields of business, government etc.

Such games achieve various degrees of success depending upon how wide their appeal is, the prolonged interest they can generate, how much variety there is in the play, how closely they approximate real-life situations, and to what degree one can acquire expertise through prolonged play. It is believed that the game according to the present invention is a game which will have a wide appeal since it can be played by participants of all ages, has a large amount of variety in the play, closely approximates real-life issues of the criminal justice system and thereby appeals to professionals in the criminal justice system as well as others interested in it, and has a good combination of luck and skill so that a degree of expertise can be acquired through prolonged play.

Key principals and components of the game according to the present invention include the provision of a game board shared by all of the players or participants, indicia on the game board to change from one "track" to the other, moveable indicia representing each of the players or teams and groups of question cards that the players must successfully answer before proceeding towards the ultimate goal.

The game according to the present invention includes a game board with a plurality of consecutive playing sections arranged thereon in two different tracks or patterns, each of the playing sections having indicia associated therewith; a plurality of moveable game pieces for movement from section to section of the game board, each moveable piece separately marked to distinguish from the other; a plurality of category questions, each category having three different levels of complexity or play; and means to variably advance movement of the moveable game pieces in the given direction on the game board.

In this arrangement, chance means are provided for advancing the moveable pieces around the game board from section to section and from track to track. Each playing section is keyed to a corresponding player piece selection means which correspond to indicia for distinguishing between the different categories of consecutive playing sections, thus selected playing sections on the game board have indicia indicating that the player-piece selection means may be employed. Preferably, the player-piece selection means are cards, the cards having a series of questions and a series of responses thereon, each series arranged in an increasing order of complexity or difficulty. The consecutive playing sections are keyed to the corresponding player-piece selection means by colored indicia.

Participants compete against each other in the form of two teams, each team being represented by a moveable player-piece. The playing sections on the game board are divided into two separate tracks disposed in a continuous path with each consecutive playing section having a corresponding category type, each differing from its adjacent neighbor. The tracks provide a "cross-over" area or box called a category space, and each category space is, in turn, linked to a retaining area or "trap" where the participating player or team must answer a challenge.

It is the primary object of the present invention to provide a parlor game that is both enjoyable to play as well as educational and instructive to the players concerning various aspects of the criminal justice system. This and other objects of the invention will become apparent from an inspection of the detailed description of the invention, from the attached drawings, and from the appended claims.

BRIEF DESCRIPTION OF THE DRAWINGS

FIG. 2 is a top prospective view of exemplary player pieces; and

FIG. 3 is a top prospective view of exemplary chance player advancement means; and FIG. 4 is a plan view of a playing card presenting questions and correct answers for use according to the present invention.

DETAILED DESCRIPTION OF THE INVENTION

Figure 1:
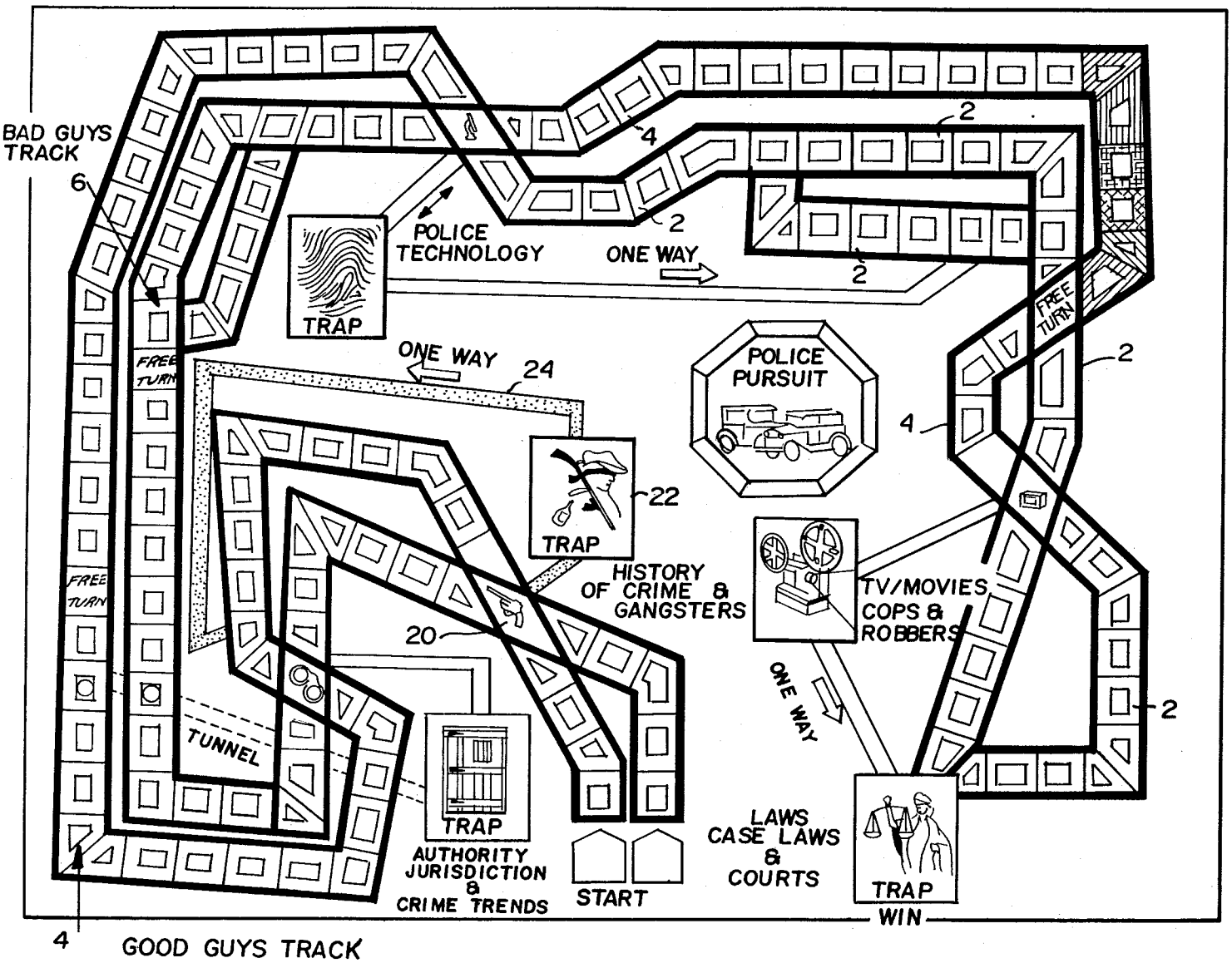
FIG. 1 is a top plan view of an exemplary game board according to the present invention.

An exemplary game board according the present invention is shown generally at 1 in FIG. 1, the game board 1 having a plurality of consecutive playing sections 2 each having indicia associated therewith, these consecutive playing sections are arranged in a continuous path or track preferably having indicia along the margin, such as a color which corresponds with a corresponding player piece. Thus there is a track for the "good guys" 4, with corresponding player piece 6 which, as represented in FIG. 2, presents the caricature of a policeman in blue uniform and a "bad guys" track 8, which corresponds to player piece 10 shown in FIG. 2, presenting the caricature of a criminal clad in black jacket, checked pants, cap and mask. Moveable game pieces 6 and 10 are provided for movement from section-to-section of the game board.

Each playing section 2 has indicia different from its adjacent neighbor, and usually this indicia is in the form of a color code. These color codes may vary in number, but necessarily there are three and preferably up to five color codes employed as indicated by the shading in the upper right-hand corner of FIG. 1. The color codes correspond to categories, and for each category there is a playing card 12, as depicted in FIG. 4, presenting alternative challenges to the opposing team. These challenges are arranged in level of difficulty which, for convenience, presents the easiest level first, and may range from beginning players to the more advanced and experienced players (or criminal justice professionals, as the case may be). These questions are arranged on card 12 with questions 14*a*, 14*b* and 14*c* arranged in increasing order of difficulty, and below corresponding answers 16*a*, 16*b* and 16*c*. The card 12 itself bears indicia which correspond to playing sections 2 on game board 1. Card 12 shows three levels of questions, however it will be understood that any number of levels may be presented on this card. Conveniently, the card is itself color coded i.e., made of a colored card stock, which color corresponds to the colored indicia of playing section 2 on the game board 1.

The player pieces are arranged at the starting point of tracks 4 and 8, player piece 6 in good guys track 4 and player piece 10 in bad guys track 8. Player pieces are advanced by a random number generating means 18 as shown in FIG. 3. The starting player or team rolls the random number generating means to determine the number of playing sections the playing piece is to be advanced. When the playing piece lands on a particular section, the player or team must correctly answer a question from the corresponding category card 12 in accordance with the level of difficulty selected at the beginning of play (14*a*, 14*b* or 14*c*). The moving player must provide the correct answer (16*a*, 16*b* or 16*c*) to the question posed by the opposing team and, if correctly answered, is allowed to again manipulate the random selection means 18 and advance a corresponding number of places. Players may move their player piece in a forward direction, a backward direction (with respect to the starting point) or a combination of the two when the random selection means signals one or more predetermined indicia, for instance a "wild card". As an example, assuming that a die is used for random selection means 18, two specific numbers are selected and if the random number generating means shows one of the two preselected numbers, the player is permitted to go in both directions in a single move—provided that there is only one change in direction (90°) and that the playing section 2 in which direction is changed is counted only once. The playing is thus advanced along the tracks generally in accordance with this procedure, however, the playing pieces may change tracks or share the same track at the appropriate junctures, as explained below. In addition, the playing pieces may advance at a rate faster than the usually step-wise manner using random selection means 18 when the player or team successfully responds to a challenge proposed by a category card 12.

Tracks 4 and 8 initially start as two separate tracks and then, at various junctures along the board, both tracks share a common playing section thus, as shown in FIG. 1, track 4 and track 8 share a common area designated as a category space 20. If a player piece lands on category space 20, the player piece automatically moves to the adjacent category trap 22. Once in a category trap, the player piece may only be moved by successfully responding to a challenge presented by category card 12; an incorrect response results in the playing piece remaining in the category trap 22 until a question is successfully answered by the player or team. At the option of the player or team, a question of a higher category level than the preselected level may be proposed (as an example, if play is at the 14*a* question level, the player or team may select a question from the 14*b* level) and, if successfully answered (see 16*b*) the player piece is advanced along one-way shortcut to a position further from the starting point either in the same track or on the opposite track. Tracks 4 and 8 intersect in a number of category spaces 20 and this number of intersections may vary in accordance with the design of the game board 1.

Any suitable random number generating means 18 or chance means may be included with the game to determine the order of play among players or teams. Preferably a die is employed. As is customary, the person or team throwing the highest number goes first.

As depicted in FIG. 1, there are five category traps 22 each having a different subject. In the embodiment specifically illustrated these categories include "History of Crime and Gangsters", "Authority/Jurisdictions and Crime Trends", "Police Technology", "T.V./Movie Cops & Robbers", and "Laws/Case Law/Courts". These categories and exemplary questions and answers are given below. The board may also be provided with photographs, artwork or other illustrations consistent with the category type and these category types are color coded or otherwise marked to show correspondence with the playing sections 2 disposed along each of paths 4 and 8.

Also provided with the game are a series of category cards 12 which correspond with the indicia on the various sections 2 of the game board 1, typically by way of color match. When a player piece lands on a playing section 2, the opposing team (not having the random number generating means 18 and movement of the playing piece) selects the appropriately colored playing card 12 and then poses a question to the moving player or team at the predetermined level of play. For each of the category types there are a number of cards each with a plurality of questions of different levels and corresponding answers to each question. Representative questions contained among the 5 illustrated categories are as follows:

TABLE I

| CATEGORY: HISTORY OF CRIME AND GANGSTERS | | |
|---|---|---|
| #1 | L1Q | In what city was Senator Robert Kennedy assassinated? |
| | L2Q | What law enforcement agency formed the first formal SWAT team in the U.S.? |
| | L3Q | Who was the mastermind behind the "Helter-Skelter" murders in the 1970's? |
| | L1A | Los Angeles |
| | L2A | Los Angeles Police Department |
| | L3A | Charles Manson |
| #2 | L1Q | Who was J. Edgar Hoovers successor as director of the FBI? Who was the second director of the F.B.I.? |
| | L2Q | What was William H. Webster's profession prior to assuming the position as director of the F.B.I.? |
| | L3Q | What federal agency do the initials N.A.T.B. represent? |
| | L1A | Clarence M. Kelly |
| | L2A | Federal judge |
| | L3A | National Auto Theft Bureau |
| #3 | L1Q | Where is the F.B.I. National Academy located? |
| | L2Q | What military base is the F.B.I Academy located on? |
| | L3Q | In 1936 the F.B.I. Police Training School became known as the F.B.I. National Police Academy. In what year did it become the F.B.I. National Academy? |
| | L1A | Quantico, Virginia |
| | L2A | Quantico Marine Corps. |
| | L3A | 1944 |

TABLE I-continued

CATEGORY: HISTORY OF CRIME AND GANGSTERS

| | | |
|---|---|---|
| #4 | L1Q | Ma Barker was killed in a shoot-out with G-men in what state? |
| | L2Q | Lake Weir, Florida was the site of a shoot-out between G-men and a famous women gangster. What was her name? |
| | L3Q | G-men forced the local sheriff to enter Ma Barker's home after the famous shoot-out to see if the occupants were dead? True or False? |
| | L1A | Florida |
| | L2A | Ma Barker |
| | L3A | False (they sent in a local black man) |
| #5 | L1Q | What holiday was the scene of a bloody 1929 shooting massacre on Chicago's North side? |
| | L2Q | What mobster escaped death by being late for the St. Valentine's Day Massacre? |
| | L3Q | How many men were killed in the St. Valentine's Day Massacre? |
| | L1A | St. Valentine's Day |
| | L2A | Bugs Moran |
| | L3A | Seven |
| #6 | L1Q | A ruthless gangster who ruled Chicago during the 1920's with a scar on the side of his face was who? |
| | L2Q | Al Capone was finally brought to trial and found guilty of what charges? |
| | L3Q | Al Capone was released from a federal prison a shattered man in 1939. His brain destroyed by what disease? |
| | L1A | Al Capone |
| | L2A | Income Tax Evasion |
| | L3A | Syphillis |
| #7 | L1Q | In the 1980's U.S. authorities in N.Y. began prosecuting defendants allegedly using pizza parlors to "launder" illegal drug profits in a scheme called the _____ _____? |
| | L2Q | The true meaning of the term La Cosa Nostra means "this thing of ours"." True or False? |
| | L3Q | U.S. Attorney William Weld made the statement "This is the golden age of law enforcement." Why? Or to what was he referring? |
| | L1Q | Pizza Connection |
| | L2A | True |
| | L3A | Increased arrest, convictions, and fines against organized crime. |
| #8 | L1Q | What public enemy #1 was gunned down while exiting a movie theater? |
| | L2Q | There was a legend that to ensure infected wounds, gunman should rub what spice on their bullets? |
| | L3Q | While acting as New York District Attorney and as a U.S. Attorney, who was responsible for the indictment and successful prosecution of several underworld figures in the 1930's? |
| | L1A | John Dillinger |
| | L2A | Garlic |
| | L3A | Thomas E. Dewey |
| #9 | L1Q | A New York gangster of the 1920's known for his violence in the bootleg business was named Legs _____; (a girl's best friend). |
| | L2Q | A New York underworld figure whose real last name was Flegenheimer, used the alias Dutch _____. |
| | L3Q | Of the estimated 227 gangland killings which took place in Chicago between 1927 and 1930, how many were actually tried and convicted? |
| | L1A | Diamond |
| | L2A | Schultz |
| | L3A | Two |
| #10 | L1Q | A five letter word representing an underworld organization is what? |
| | L2Q | The process by which an officer endeavors to obtain information about a case from an unwilling person describes what? |
| | L3Q | Where and when did the existence of an underworld organization known as the mafia first surface? |
| | L1A | Mafia |
| | L2A | Interrogation |
| | L3A | New Orleans, 1890 |

TABLE II

CATEGORY: AUTHORITY, JURISDICTIONS, CRIME TRENDS

| | | |
|---|---|---|
| #1 | L1Q | The authority to make law rests with which branch of the government? |
| | L2Q | What provision in the U.S. Constitution addresses a conflict between state and federal statutes? |
| | L3Q | Historically, during what two-hour time frame are more police officers killed than any other? |
| | L1A | Legislature |
| | L2A | Supremacy Clause |
| | L3A | 10P–Midnight |
| #2 | L1Q | Which one of the fifty states does not base its legal system on the old English Common Law? |
| | L2Q | For what purpose is a Writ of Habeas Corpus issued? |
| | L3Q | What does the state of Louisiana base its legal system on instead of Common Law? |
| | L1A | Louisiana |
| | L2A | To obtain judicial determination of the legality of an individual's custody or confinement. |
| | L3A | Roman Civil Law |
| #3 | L1Q | From where does the authority and the power of the U.S. Supreme Court come? |
| | L2Q | How many justices serve on the Supreme Court of the United States? |
| | L3Q | Who was the chief justice of the U.S. Supreme Court in 1985? |
| | L1A | U.S. Constitution |
| | L2A | Nine |
| | L3A | Warren E. Burger |
| #4 | L1Q | When pursuing a suspect, police have the authority to make a warrantless entry into a dwelling if they are in _____ _____. |
| | L2Q | With the exception of Louisiana, all states are subdivided into counties. What are their's called? |
| | L3Q | A police officer can arrest in felony situations even though the offense may not have occurred in his presence if he can establish what? |
| | L1A | hot pursuit |
| | L2A | Parish |
| | L3A | Probable Cause |
| #5 | L1Q | How long is the term of office for a justice of the U.S. Supreme Court? |
| | L2Q | How are vacancies on the U.S. Supreme Court filled? |
| | L3Q | How many amendments are there to the U.S. Constitution? |
| | L1A | Lifetime during good behavior |
| | L2A | Appointed by President, confirmed by Senate |
| | L3A | 26 |
| #6 | L1Q | Does federal law apply to U.S. citizens in foreign countries? Yes or No? |
| | L2Q | State criminal statutes are limited by a requirement that each must be founded upon an ex- |

TABLE II-continued

| CATEGORY: AUTHORITY, JURISDICTIONS, CRIME TRENDS | | |
|---|---|---|
| | | pressed or implied grant of authority from where? |
| | L3Q | What section of the U.S. is governed by criminal codes enacted by the federal government? |
| | L1A | Yes |
| | L2A | U.S. Constitution |
| | L3A | District of Columbia |
| #7 | L1Q | There are no federal Common Law Crimes. True or False? |
| | L2Q | In the absence of a statute controlling a particular act, authority to deal with the act comes from where? |
| | L3Q | What gives a state the authority to protect the health, safety, and welfare of its citizens? |
| | L1A | True (except in Washington, D.C.) |
| | L2A | Common Law |
| | L3A | Its police power |
| #8 | L1Q | What is the only major crime defined by the U.S. Constitution? |
| | L2Q | What is the common result of a crime committed by one who is not a U.S. citizen? |
| | L3Q | What is the Latin term describing a crime that is prohibited by statute? |
| | L1A | Treason |
| | L2A | Deportation |
| | L3A | Malum Prohibitum |
| #9 | L1Q | A statute that fails to give notice of what conduct is prohibited is invalid because it is what? |
| | L2Q | A law that when enacted makes offenses retroactive is known as what kind of law? |
| | L3Q | A law that inflicts punishment without a judicial trial is called what? |
| | L1A | Void for Vagueness |
| | L2A | Ex Post Facto Law |
| | L3A | A Bill of Attainder |
| #10 | L1Q | The Rules of Criminal Procedure control the conduct of the criminal trial. True of False? |
| | L2Q | The procedure controlling an appeal of a trial verdict are what body of rules? |
| | L3Q | What controls the introduction of evidence in a federal criminal trial? |
| | L1A | True |
| | L2A | The Rules of Appellate Procedure |
| | L3A | The Federal Rules of Evidence |

TABLE III

| CATEGORY: POLICE TECHNOLOGY | | |
|---|---|---|
| #1 | L1Q | What is the official publication of the International Association of Chiefs of Police? |
| | L2Q | In Minneapolis, the National Council of Jewish Women is distributing a banner for display in the rear window of stranded automobiles. What does it say? |
| | L3Q | The "CALL POLICE" banner for stranded motorist is distributed by what women's group? |
| | L1A | Police Chief |
| | L2A | "CALL POLICE" |
| | L3A | The National Council of Jewish Women |
| #2 | L1Q | ALCOSCAN is a saliva test for what? |
| | L2Q | South Florida's annual "Pig Bowl" is a football classic between what two police agencies? |
| | L3Q | What does the acronym N.H.T.S.A. stand for |
| | L1A | Blood alcohol |
| | L2A | Metro-Dade & City of Miami |
| | L3A | National Highway Traffic Safety Administration |

TABLE III-continued

| CATEGORY: POLICE TECHNOLOGY | | |
|---|---|---|
| #3 | L1Q | Can the mouthwash Listerine effect a breath sobriety test? |
| | L2Q | Listerine mouthwash can effect breath sobriety test because it contains 26.9% alcohol. True of False? |
| | L3Q | What did the FBI create to standardize crime reporting nationwide? |
| | L1A | Yes |
| | L2A | True |
| | L3A | Uniform Crime Reports (U.C.R.) |
| #4 | L1Q | Generally, trace amounts of alcohol in the breath due to the use of Listerine are not found _____ minutes after use. |
| | L2Q | "Syncro-Fire" is a product of Electronics Warfare Associates which allows a SWAT commander to monitor and discharge weapons from all firing points. True or False? |
| | L3Q | What is the "Ticket Wizard?" |
| | L1A | Ten |
| | L2A | True |
| | L3A | A computerized parking ticket book |
| #5 | L1Q | The R.I.C.O. Act was an attack on what? |
| | L2Q | What does R.I.C.O. stand for? |
| | L3Q | Nearly ⅔'s of all cocaine entering the U.S. is smuggled aboard commercial airliners according to U.S. Customs. True or False? |
| | L1A | Organized Crime |
| | L2A | Racketeer Influenced and Corrupt Organization |
| | L3A | False (about ¼) |
| #6 | L1Q | The TSG82 is a single unit portable machine, containing two computer controlled tape recorders, an 80 column dot matrix printer, an 80 column by two line liquid crystal display, a switchable audio filter, and rapid ID control switches. What is it used for? |
| | L2Q | A Michigan State University study of police pursuits found that 37% of fleeing drivers were under 21. True or False? |
| | L3Q | The N.Y.P.D. has how many precincts? 30, 45, or 75? |
| | L1A | Wire taps |
| | L2A | True |
| | L3A | 75 |
| #7 | L1Q | The U.S. Marshall's Service operates an inmate transportation service. What is N.P.T.S.? |
| | L2Q | Bogus electrical contractors were targeted in what city's major sting operation dubbed "AMPSCAM?" |
| | L3Q | Approximately how many states have enacted "shield laws" to protect confidential sources? One-fourth, one-half, three-fourths, or all? |
| | L1A | National Prison Transportation System |
| | L2A | New York |
| | L3A | One-half |
| #8 | L1Q | In northern states, the first snowfall means what for patrolmen? |
| | L2Q | Is police radar considered a proactive or a reactive tool? |
| | L3Q | What three factors must be compiled and studied concerning traffic accidents to determine preventative enforcement? |
| | L1A | Traffic accidents |
| | L2A | Proactive |
| | L3A | Time of accident, location, and violation |
| #9 | L1Q | To what three emergency services does 911 connect in most applications? |
| | L2Q | In police communications centers what does C.A.D. refer to? |

TABLE III-continued

| CATEGORY: POLICE TECHNOLOGY | |
|---|---|
| L3Q | An enhanced 911 system (with ANI and ALI) provide what information to police without the caller speaking? |
| L1A | Police, fire, ambulance (medical) |
| L2A | Computer Aided Dispatch |
| L3A | Caller's phone number and address |
| #10 L1Q | "Super Glue" is used to lift fingerprints? Yes or No? |
| L2Q | A gas chromatograph is used most often by police around the world to detect trace elements in vapor emitted by: (a) drugs, (b) explosives, (c) decaying flesh, or (d) environmental violations of the law? |
| L3Q | When studying vehicle dynamics, police drivers are taught that (mass) × (velocity)$^2$ by radius of turn equals what? |
| L1A | Yes (when using a laser). |
| L2A | (b) explosives |
| L3A | Centrifugal force |

TABLE IV

| CATEGORY: TV/MOVIE COPS & ROBBERS | |
|---|---|
| #1 L1Q | A motion picture released in the 1980's depicts the exploits of a hard-nosed cop who checked a black inmate out of prison for two days in order to catch a cop killer. Name it. |
| L2Q | In the motion picture "48 Hrs." central character Det. Jack Cates was played by what "Down and Out in Beverly Hills" actor? |
| L3Q | In the motion picture "48 Hrs." the cop killer that Det. Cates was pursuing was named? |
| L1A | 48 Hrs. |
| L2A | Nick Nolte |
| L3A | Luther |
| #2 L1Q | In the motion picture "48 Hrs." central character Reggie Hammond (the black convict) was played by actor? |
| L2Q | In the motion picture "48 Hrs." Det. Jack Cates traveled about town in what type vehicle? |
| L3Q | In the motion picture "48 Hrs." what was the name of Det. Cates girl? |
| L1A | Eddie Murphy |
| L2A | A white cadillac convertible |
| L3A | Elaine |
| #3 L1Q | Name a T.V. police drama which aired between Feb. 1975 and June 1976 depicting the exploits of a squad of officers in a semi-military attire which brought army-style warfare to big-city police work. |
| L2Q | What does the acronym S.W.A.T. stand for? |
| L3Q | In the T.V. police drama S.W.A.T. what was the nick-name given to the unit commander Lt. Don Harrelson? |
| L1A | S.W.A.T. |
| L2A | Special Weapons and Tactics |
| L3A | "HONDO" |
| #4 L1Q | Name a T.V. police series which aired between Sept. 1976 and Jan. 1977 depicting the exploits of an idealistic New York City cop who had a shaggy dog and exposed corruption within the department? |
| L2Q | The T.V. police series Serpico depicted the life of a real ex-New York police officer named? |
| L3Q | In the T.V. police series Serpico, central character Frank Serpico was played by what actor? |
| L1A | Serpico |
| L2A | Frank Serpico |
| L3A | David Birney |

TABLE IV-continued

| CATEGORY: TV/MOVIE COPS & ROBBERS | |
|---|---|
| #5 L1Q | Name a T.V. police series which aired between Sept. 1955 & Sept. 1958 depicting the exploits of a Royal Northwest Mounted Policeman as he fought crime in the Yukon. |
| L2Q | In the T.V. police series "Sergeant Preston of the Yukon" central character Sgt. Preston could be heard shouting what familiar phrase to his team of huskies? |
| L3Q | In the T.V. police series "Sergeant Preston of the Yukon" which aired in the late 1950's, central character Sgt. Preston was played by what actor? |
| L1A | Sergeant Preston of the Yukon |
| L2A | "On, King! On, you huskies". |
| L3A | Richard Simmons |
| #6 L1Q | Name a T.V. detective series which aired between Oct. 1958 and Sept. 1964 depicting the exploits of two private detectives who operated an agency on a famous strip in Hollywood, California? |
| L2Q | In the T.V. detective series "77 Sunset Strip", central characters Stuart Bailey and Jeff Spencer were occasionally assisted on their cases by a jive-talking, hair-combing parking attendant named? |
| L3Q | In the T.V. detective series "77 Sunset Strip", what was the name of the restaurant located next door to No. 77 Sunset Strip? |
| L1A | 77 Sunset Strip |
| L2A | Kookie or Gerald Lloyd Kookson III |
| L3A | Dino's |
| #7 L1Q | Name a T.V. detective series which aired between Oct. 1973 and Aug. 1974 depicting the exploits of a flamboyant, street-wise black detective? |
| L2Q | In the T.V. detective series "Shaft", central character John Shaft was played by actor? |
| L3Q | The theme for the T.V. detective series "Shaft" (Theme from Shaft) was composed by writer _____, which won him an Academy Award. |
| L1A | SHAFT |
| L2A | Richard Roundtree |
| L3A | Isaac Hayes |
| #8 L1Q | Name a syndicated T.V. police series which produced 156 episodes, the first being released in the fall of 1956 depicting the exploits of a Sheriff in Cochise County, Arizona as he enforced the law in that portion of the country? |
| L2Q | In the T.V. police series "The Sheriff of Cochise", Sheriff Frank Morgan was promoted in 1958 to _____, which also changed the name of the program. |
| L3Q | In the T.V. police series "The Sheriff of Cochise", actor John Bromfield played what central character _____? |
| L1A | The Sheriff of Cochise |
| L2A | U.S. Harshal |
| L3A | Frank Morgan |
| #9 L1Q | Name a T.V. police series which aired between Sept. 1970 and Jan 1971, depicting the exploits of a force of three agents who silently worked to infiltrate organized crime in southern California? |
| L2Q | In the T.V. police series "The Silent Force", actor Ed Nelson played what central character _____, (like the brushman). |
| L3Q | In the T.V. police series "The Silent Force", character Amelia Cole was played by actress Linda _____, (but not knight). |
| L1A | The Silent Force |

TABLE IV-continued

| CATEGORY: TV/MOVIE COPS & ROBBERS | | |
|---|---|---|
| | L2A | Ward Fuller |
| | L3A | Day |
| #10 | L1Q | Name a T.V. western which aired between Sept. 1953 and Sept. 1954 depicting the exploits of a high flying Arizona pilot-rancher who pursued wrongdoers with his plane instead of a horse? |
| | L2Q | In the T.V. western "Sky King", central character Sky King was assisted by his teenage niece named _____? |
| | L3Q | In the T.V. western "Sky King" which aired between Sept. 1953 and Sept. 1954, Sky King's twin-engine airplane was called? |
| | L1A | Sky King |
| | L2A | Penny |
| | L3A | The Songbird |

TABLE V

| CATEGORY: LAWS, CASE LAW, AND COURTS | | |
|---|---|---|
| #1 | L1Q | There are no women on the U.S. Supreme Court. True or False? |
| | L2Q | Who was the first woman appointed to the U.S. Supreme Court? |
| | L3Q | Who appointed the first woman justice to the U.S. Supreme Court? |
| | L1A | False |
| | L2A | Sandra Day O'Conner |
| | L3A | President Ronald Reagan |
| #2 | L1Q | The first ten amendments to the U.S. Constitution are known as what? |
| | L2Q | Which amendment to the U.S. Constitution makes the Bill of Rights applicable to the states? |
| | L3Q | The fourteenth amendment to the U.S. Constitution prohibits deprivation of life, liberty or property without what? |
| | L1A | Bill of Rights |
| | L2A | Fourteenth Amendment |
| | L3A | Due process of law |
| #3 | L1Q | The privilege against self-incrimination is protected by which amendment to the U.S. Constitution? |
| | L2Q | The right to counsel is protected by which amendment to the U.S. Constitution? |
| | L3Q | Which Bill of rights guarantee has been specifically held inapplicable in the states? |
| | L1A | Fifth |
| | L2A | Sixth |
| | L3A | Right to a Grand Jury Indictment (Hurtado V. Calif, 110 U.S. 516 (1884)) |
| #4 | L1Q | The U.S. Supreme Court has held that only an unreasonable search of private property is protected by the fourth amendment. True or False? |
| | L2Q | The right to be secure against unreasonable search and seizure is guaranteed by which amendment? |
| | L3Q | A person claiming entitlement to fourth amendment protection against unreasonable search and seizure must be able to establish what? |
| | L1A | False (Katz v. U.S., 389 U.S. 347 (1967)) |
| | L2A | Fourth |
| | L3A | A reasonable expectation of privacy |
| #5 | L1Q | What rights must an individual be given at the time of a custodial (in custody) interrogation? |
| | L2Q | Name two of the Miranda warnings? |
| | L3Q | The privilege against self-incrimination is not applicable to non-testimonial evidence or physical identification procedures. True or False? |

TABLE V-continued

| CATEGORY: LAWS, CASE LAW, AND COURTS | | |
|---|---|---|
| | L1A | Miranda Warnings |
| | L2A | Right to remain silent, right to an attorney, right to have attorney appointed if indigent, anything you say can be used against you in a court of law |
| | L3A | True |
| #6 | L1Q | Miranda warnings are required onlY after a person is arrested and the police intend to question him. True or False? |
| | L2Q | Miranda warninqs are not required if the offense is a minor traffic offense and no jail sentence will be imposed. True or False? |
| | L3Q | Give four exceptions to the requirements that Miranda warnings be given to a suspect? |
| | L1A | False (they are required when a person is taken into custody or otherwise deprived of their freedom for purposes of interrogation). |
| | L2A | False (no exception for minor crimes/sentence irrelevant) |
| | L3A | Public safety, volunteered statements, spontaneous utterances, clarifying questions, identification questions, and questions asked by non-police persons. |
| #7 | L1Q | *Modus Operandi* means "the body of the crime" and without it one can not be convicted of murder? True or False? |
| | L2Q | *Corpus Delicti* means "the body of the crime." True or False? |
| | L3Q | *Malum in se* is a Latin term given to an act of illegality. What does it mean? |
| | L1A | False (it means the manner of operation) |
| | L2A | True |
| | L3A | The act is evil in itself |
| #8 | L1Q | *Venire* is Latin for what? |
| | L2Q | *Res Gestae* is the Latin word for what? |
| | L3Q | *Quo Warranto* is the Latin term meaning what? |
| | L1A | Jury selection process |
| | L2A | The thing done |
| | L3A | By what right or authority |
| #9 | L1Q | Most jurisdictions classify as felonies all crimes punishable by death or imprisonment for more than one year. True or False? |
| | L2Q | What is mayhem? |
| | L3Q | What is felony murder? |
| | L1A | True |
| | L2A | Dismemberment or removal of body parts |
| | L3A | A killing even if accidental which results during the commission of a felony crime. |
| #10 | L1Q | It is a legally valid defense to a crime that the defendant was not aware that his act was illegal. True or False? |
| | L2Q | What is the common remedy for wrongfully or illegally seized evidence? |
| | L3Q | What is the name of the doctrine which provides for the exclusion of all evidence which is seized as a result of a prior unlawful seizure? |
| | L1A | False (ignorance to the law is no excuse) |
| | L2A | Excluded under the Exclusionary Rule |
| | L3A | Fruit of the Poisonous Tree Doctrine |

RULES OF THE GAME AND METHOD OF PLAY

It will be understood that the rules of the game and the method of play are subject to variation within a wide range, the principal factor being that the player, when faced with a question, provides the appropriate answer and advances his or her respective piece. An element of strategy is also included in order to enable one player or team to advance their position with respect to, and at the expense of, the other player or team. One set of rules embodying this game is as follows:

The development of this educational board game was inspired by those working within the criminal justice system who desired a medium to relax, and at the same time, become more knowledgeable within their chosen profession. Newcomers to police work will find this game a refreshing and entertaining method of learning and a supplemental must to their criminal justice studies or police academy. Additionally, those persons remotely interested in the intricacies of police work will be amazed at what the police can and cannot do. Law enforcement combined with the interaction of the courts serves as the fabric that holds our American society in due bounds. All interested citizens should know more.

The objective of the game is to provide a learning experience whereby one team, consisting of one or more players, races and pursues the other through the dimensions of chance, skill and strategy to the board's conclusion. The board traverses the various aspects of police work and concludes where most police action does—in the courts!

As explained in detail above, and as illustrated in the attached drawings, the equipment required includes:

1. A learning board or game board 1 consisting of blue lined (for good guys) track 4, and black lined (for bad guys) track 8 and five color coded category traps 22.

2. One die 18, a blue marker 6 and a black marker 10.

3. Five stacks of color coded category question and answer cards 12 corresponding with similarly marked (color coded) traps, each card 12 consisting of three levels of questions on one side and corresponding answers below. Cards 12 may be arranged with questions on one side and answers on the other. There may be as many as 400 cards in each category and the category cards may be exchanged from a larger selection or "library" of cards.

4. Minute timer—optional.

In this illustration there are 3 levels of play or difficulty. They are:

Level One—for people not familiar with the criminal justice system,

Level Two—for people associated with the criminal justice system at entry level and beyond, and Level Three—for people proficient at Level Two or willing to be challenged by the complicated workings of the criminal justice system.

Before play begins, the players establish who will be on each team if more than two players are participating. The level at which the game will be played is also decided; both teams need not play at the same level.

Each team rolls the die. Low roll chooses whether they will be the good guys or the bad guys. High roll begins play. Players move their marker according to the roll of die. Color coded spaces determine what category question will be asked by the opposing team. Once a question is asked by the opposing team and answer rendered by the moving team, the category question and answer card is placed at the bottom or rear of the stack. When a question is correctly answered, the team maintains control of the die and rolls again.

Teams may move their marker in either direction on their track or their opponent's track, shifting from one track to the other where appropriate, with the object of landing on the nearest category space where the tracks cross. With a roll of certain "wild card" numbers (in this illustration, the numbers three or six), the marker is permitted to go in both directions on one move. For example, on a six roll the player could move four spaces forward and two back, or any other combination, as long as direction changes only once and the turnaround space is only counted once. This increases the odds of landing on a category space, landing on the opponent, or perhaps avoiding an undesirable category question.

Landing on a category space automatically places the player in the appropriate category trap. Category traps include: History of Crime & Gangsters, Authority/Jurisdictions & Crime Trends, Police Technology, TV/Movie Cops & Robbers, Laws/Case Law/Courts, in this illustration, each marked with the appropriate representation of the subject. Each of the category traps must be mastered before the player can continue the race. Once in the category trap the player must make a decision. If playing at Level One, the player must answer a Level One question before returning to the category space 20 and racing on to the next category trap. However, the player may opt to answer a higher level question, in this example a Level Two question, and proceed through the one-way shortcut and advance the team or player's position on the board provided the question is correctly answered. A wrong answer at either level of difficulty results in play going to the opposing person or team. A correct answer at game level allows the player to return to the category space and roll and proceed toward the next category trap. A correct answer at the next level, allows the player to advance to the apace at the end of the one-way shortcut 24. Once at the end of the shortcut, the appropriate question must be answered or the player will lose control of the die.

While in the category trap, the player may request any level question desired each time the roll of the die is returned to that player or team. The player remains in a category trap until a correct answer is given.

When playing at Level Three, a team can advance along the shortcut only if they can correctly answer the question first drawn from within the category trap. If the first question is not correctly answered, they loose control of the die and cannot be asked another question until the opposing team fails to give a correct answer. This continues until a correct answer is given, at which time the player must return to the category space and roll the die. In normal movement between traps, a team will roll and answer until an incorrect answer is given, at which time the opposing team is allowed to roll and proceed again until a question is answered incorrectly and play is turned over to the opponent(s).

Both teams continue until the final category is reached—in this example, it is Law/Case Law & Courts. The first team to arrive at the final trap and able to answer their question at the preselected game level from within this category trap—wins the game.

Penalties for imprudent choices are provided as a learning reinforcement means. Should a player be able to land on his opponent's space in the opponent's track, the opponent is sent back to the nearest category trap, and must resume play there on the next turn to exit the trap in the same manner as normal play. Prior to the first category trap, which is History of Crime & Gangsters, as illustrated in FIG. 1, there is no penalty.

To encourage punctual answers and maintain the speed of play and level of interest, opponents can announce, at any time after reading a question, that they are imposing an earlier-agreed upon time limit, say 3 minutes, on rendering the answer. After three minutes, the answering team is deemed to be in default and the team asking the question can take control of the die if the correct answer is not given. If more than one player is on a team, only the spokesperson can render an "official" answer. Only the spokesperson can announce and give one answer after team discussion; other responses are not accepted.

From the above disclosure, appended drawings and study of the rules, together with personal experience in playing the game itself, players will quickly become skilled in game play and, more importantly, learn important and necessary information concerning the criminal justice system all in a spirit of fun coupled with healthy competition.

While the invention has been herein shown and described in what is presently conceived to be the most practical and preferred embodiment of the invention, it will be apparent to those of ordinary skill in the art that many modifications thereof may be made within the scope of the invention, which scope is to be accorded to broadest interpretation of the appended claims so as to encompass all equivalent structures and devices.

What is claimed is:

1. An educational board game apparatus comprising:

(a) a pair of tokens each one representing one of the players;

(b) a game board with a multiplicity of consecutive playing sections arranged thereon, each of said playing sections having indicia thereon and arranged cooperatively to define a continuous first track and continuous second track, each of the tracks defining a path along which the tokens are moveable in random increments, the two tracks intersecting each other at a plurality of predetermined intersection points, each of the intersection points connected via a path to a retaining area and in turn a one way path leading back to the first or second track, each of the tracks including a starting space, a finishing space and as many different indicia as there are intersection points;

(c) a random number generating means for advancing the tokens around the game board from section to section; and (d) a plurality of decks of cards, one deck per intersection point, each card in each deck having at least two levels of questions thereon of different levels of difficulty concerning the field of criminal justice, each of the cards of each deck identified by indicia common to the corresponding intersection point and distinct from the indicia on the cards of the other categories.

2. A game as recited in claim 1, in which there are n intersection points, n retaining areas, n different sets of playing sections, and n decks of cards.

3. A game as recited in claim 1, in which there are three sets of questions on each card, arranged in increasing order of difficulty, and three answers corresponding to each of the questions.

4. A game as recited in claim 1, in which both the first track and the second track have at least one Free Turn space thereon devoid of indicia.

5. A game as recited in claim 1 in which the first track has a first indicia thereon and the second track has a second indicia thereon, the two indicia being different from each other.

6. A game as recited in claim 5, in which each token has indicia thereon corresponding with the indicia on each track.

7. A game as recited in claim 6, in which one token has a police officer's caricature thereon and the other token has a criminal's caricature thereon.

8. A game as recited in claim 1, in which the random member generating means has six sides.

9. A game as recited in claim 8, in which each of the six sides has a different indicia thereon representing a number ranging from 1 to 6.

* * * * *